US009719511B2

(12) United States Patent
Imai et al.

(10) Patent No.: US 9,719,511 B2
(45) Date of Patent: Aug. 1, 2017

(54) SCROLL COMPRESSOR IN WHICH A FIXED SCROLL AND AN ORBITING SCROLL ARE PLACED BETWEEN A PARTITION PLATE AND A MAIN BEARING

(71) Applicant: Panasonic Intellectual Property Management Co., Ltd., Osaka (JP)

(72) Inventors: Yusuke Imai, Shiga (JP); Takeshi Ogata, Osaka (JP); Sadayuki Yamada, Shiga (JP); Hidenobu Shintaku, Shiga (JP); Atsushi Sakuda, Shiga (JP); Takashi Morimoto, Kyoto (JP); Akihiro Hayashi, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 14/888,373

(22) PCT Filed: Apr. 28, 2014

(86) PCT No.: PCT/JP2014/002370
§ 371 (c)(1),
(2) Date: Oct. 30, 2015

(87) PCT Pub. No.: WO2014/178191
PCT Pub. Date: Nov. 6, 2014

(65) Prior Publication Data

US 2016/0084250 A1 Mar. 24, 2016

(30) Foreign Application Priority Data

Apr. 30, 2013 (JP) ..... 2013-094881

(51) Int. Cl.
*F03C 2/00* (2006.01)
*F03C 4/00* (2006.01)
(Continued)

(52) U.S. Cl.
CPC ..... *F04C 18/0269* (2013.01); *F04C 18/0215* (2013.01); *F04C 18/0261* (2013.01);
(Continued)

(58) Field of Classification Search
CPC ..... F04C 18/0215; F04C 18/0261; F04C 18/0269; F04C 27/001; F04C 27/005;
(Continued)

(56) References Cited

U.S. PATENT DOCUMENTS 5,192,202 A * 3/1993 Lee ..... F04C 27/005 418/55.5
5,435,707 A 7/1995 Hirano et al.
(Continued)

FOREIGN PATENT DOCUMENTS

CN 1065595 5/2001
CN 101265907 A 9/2008
(Continued)

OTHER PUBLICATIONS

Search Report for Chinese patent application No. 201480024502.6, Oct. 10, 2016, with English translation (15 pages).
(Continued)

*Primary Examiner* — Theresa Trieu
(74) *Attorney, Agent, or Firm* — Hamre, Schumann, Mueller & Larson, P.C.

(57) ABSTRACT

A scroll compressor of the present invention includes a partition plate, a fixed scroll, an orbiting scroll, a rotation-restraining member, a main bearing, a discharge space, a ring-shaped first seal member and a ring-shaped second seal member. A pressure in the medium pressure space is set lower than that in the discharge space and higher than that in the low pressure space. The first seal member and the second seal member are sandwiched by the partition plate by means of a closing member, the fixed scroll can move in an
(Continued)

axial direction of the fixed scroll between the partition plate and the main bearing. If a high pressure is applied to the discharge space, the fixed scroll can be pressed against the orbiting scroll.

5 Claims, 11 Drawing Sheets

(51) Int. Cl.

| | |
|---|---|
| ***F04C 2/00*** | (2006.01) |
| ***F04C 18/02*** | (2006.01) |
| ***F04C 27/00*** | (2006.01) |
| ***F04C 29/12*** | (2006.01) |
| ***F04C 28/26*** | (2006.01) |
| ***F04C 29/00*** | (2006.01) |
| *F01C 17/06* | (2006.01) |
| *F04C 23/00* | (2006.01) |

(52) U.S. Cl.
CPC ..... *F04C 27/001* (2013.01); *F04C 27/005* (2013.01); *F04C 27/008* (2013.01); *F04C 28/26* (2013.01); *F04C 29/005* (2013.01); *F04C 29/0085* (2013.01); *F04C 29/12* (2013.01); *F04C 29/124* (2013.01); *F04C 29/128* (2013.01); *F01C 17/066* (2013.01); *F04C 18/0276* (2013.01); *F04C 23/008* (2013.01)

(58) Field of Classification Search
CPC ..... F04C 27/008; F04C 28/26; F04C 29/005; F04C 29/0085; F04C 29/12; F04C 29/124; F04C 29/128; F04C 23/008
USPC ..... 418/55.1–55.6, 57, 142, 180
See application file for complete search history.

(56) References Cited

U.S. PATENT DOCUMENTS

| | | | | |
|---|---|---|---|---|
| 5,447,418 | A * | 9/1995 | Takeda | F04C 27/005 418/55.5 |
| 5,494,422 | A * | 2/1996 | Ukai | F04C 18/0215 418/55.1 |
| 5,496,161 | A | 3/1996 | Machida et al. | |
| 6,318,982 | B1 | 11/2001 | Fujii et al. | |
| 6,746,224 | B2 * | 6/2004 | Itoh | F04C 27/005 418/55.5 |
| 7,074,013 | B2 * | 7/2006 | Seibel | F04C 18/0215 418/55.1 |
| 8,668,478 | B2 * | 3/2014 | Su | F04C 27/005 418/55.5 |
| 8,932,036 | B2 * | 1/2015 | Monnier | F04C 27/005 418/55.5 |

FOREIGN PATENT DOCUMENTS

| | | |
|---|---|---|
| CN | 101886628 | 11/2010 |
| EP | 1024289 | 8/2000 |
| GB | 2291681 A | 1/1996 |
| JP | H0526180 A | 2/1993 |
| JP | 6-346871 | 12/1994 |
| JP | 11-182463 | 7/1999 |
| JP | 2000-220585 | 8/2000 |
| JP | 2002-339867 | 11/2002 |
| JP | 2009-138640 | 6/2009 |
| JP | 2011-085040 | 4/2011 |

OTHER PUBLICATIONS

Chinese Search Report dated Jul. 21, 2016, Chinese Patent Application No. 201480024543.5 with English translation (4 pages).
Chinese Search Report dated Jul. 15, 2016, Chinese Patent Application No. 201480024409.5 with English translation (4 pages).
International Search Report, Jul. 22, 2014; PCT/JP2014/002370 (4 pages including English translation).
Extended European Search Report, Mar. 23, 2016; European Patent Application No. 14791116.8 (8 pages).

* cited by examiner

[Fig. 1]
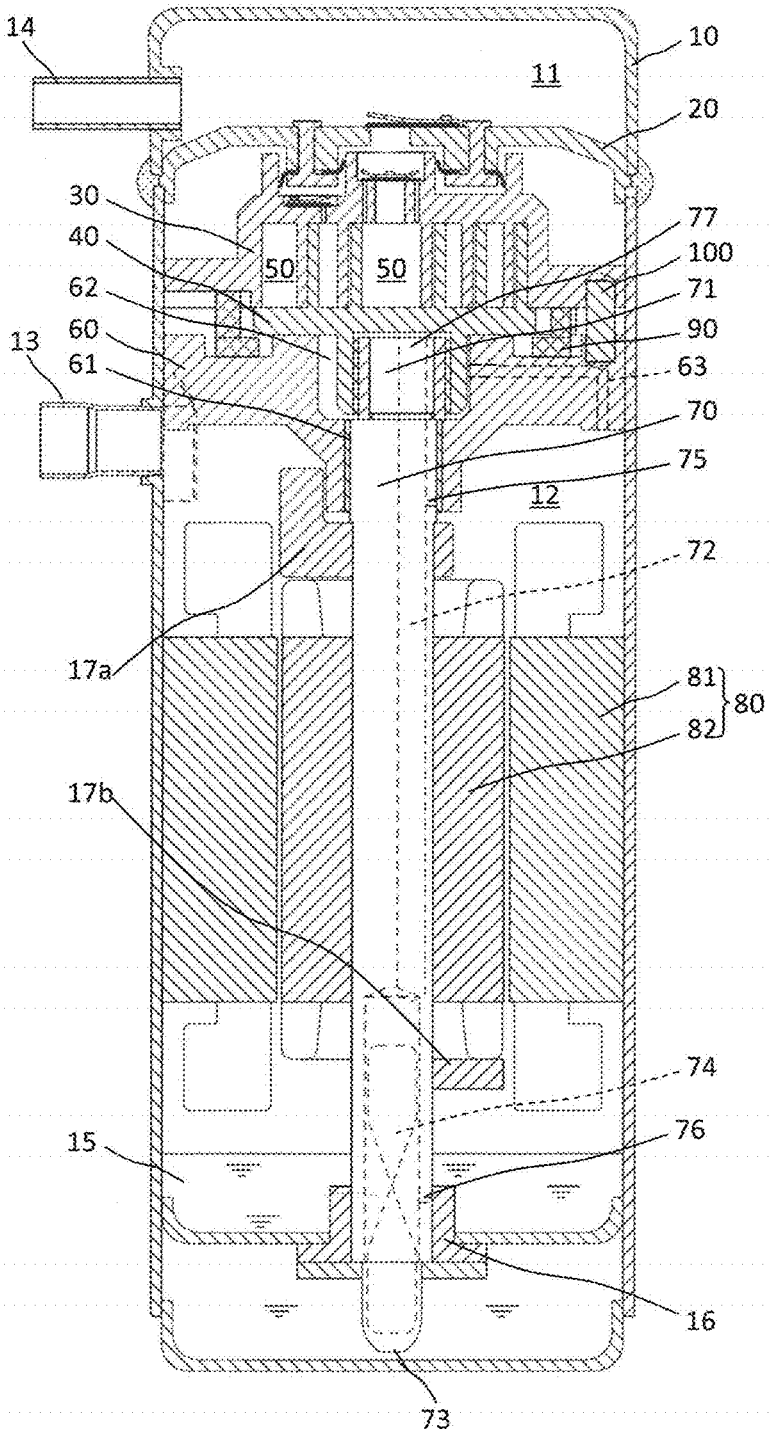

[Fig. 2]
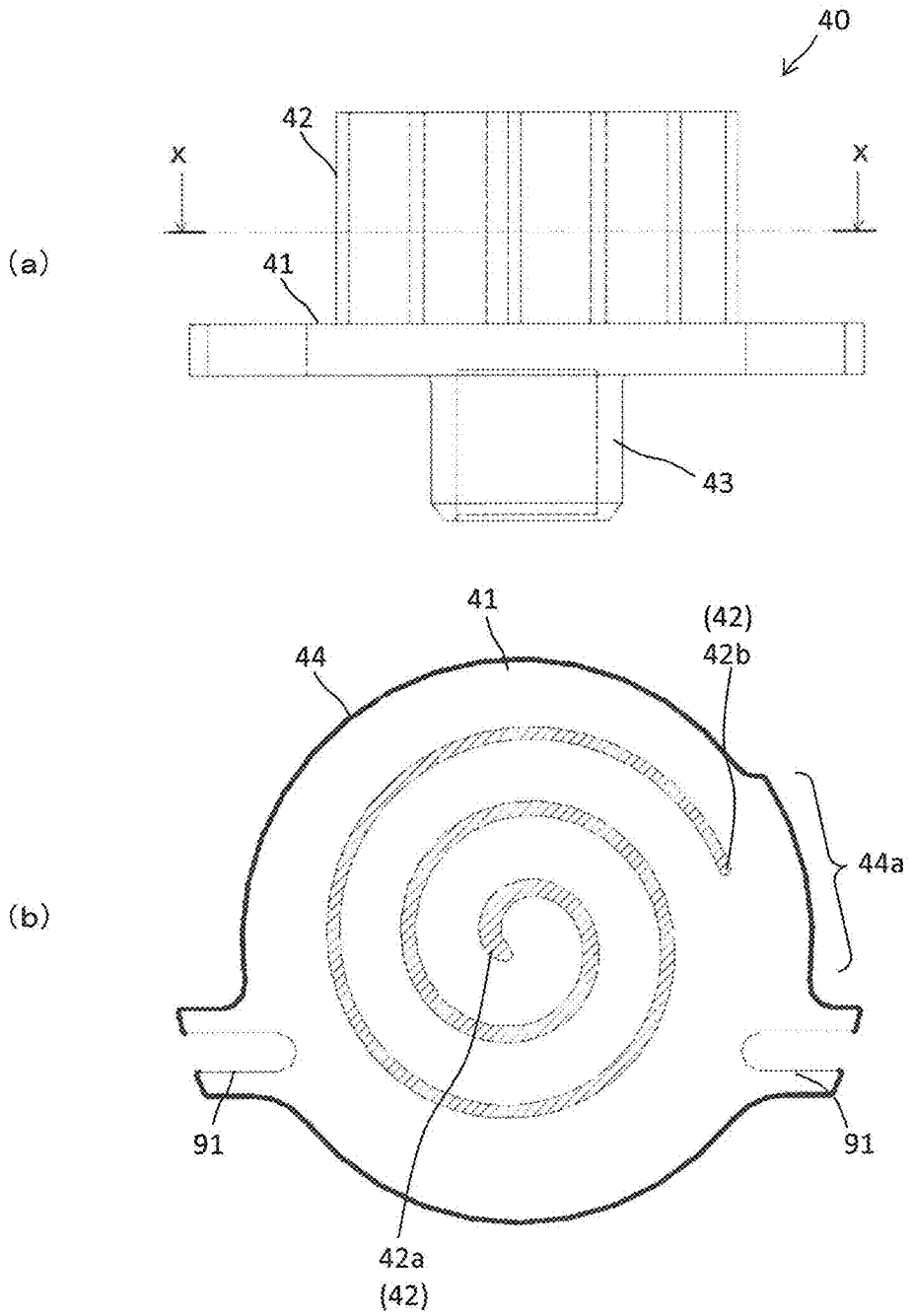

[Fig. 3]
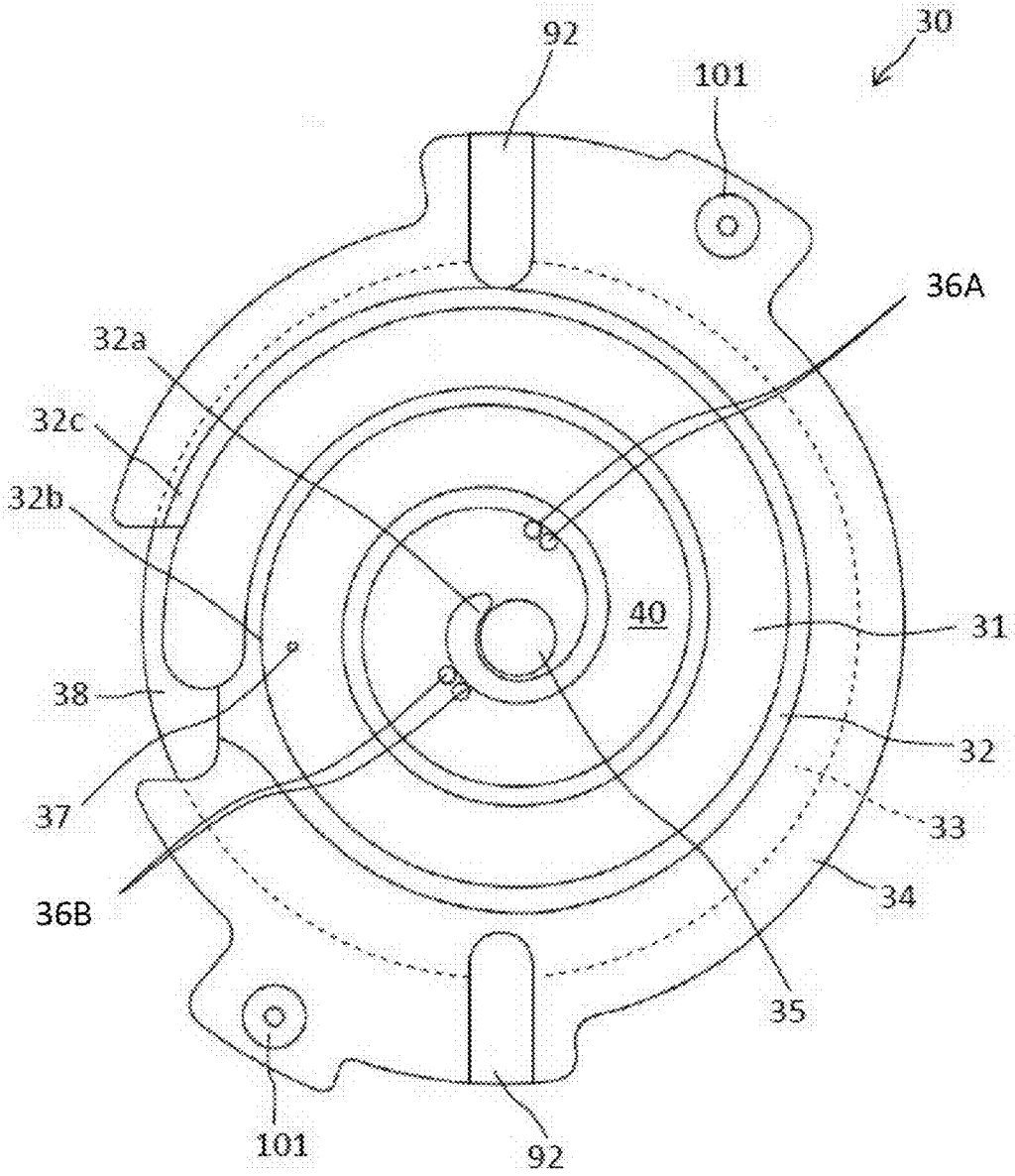

[Fig. 4]
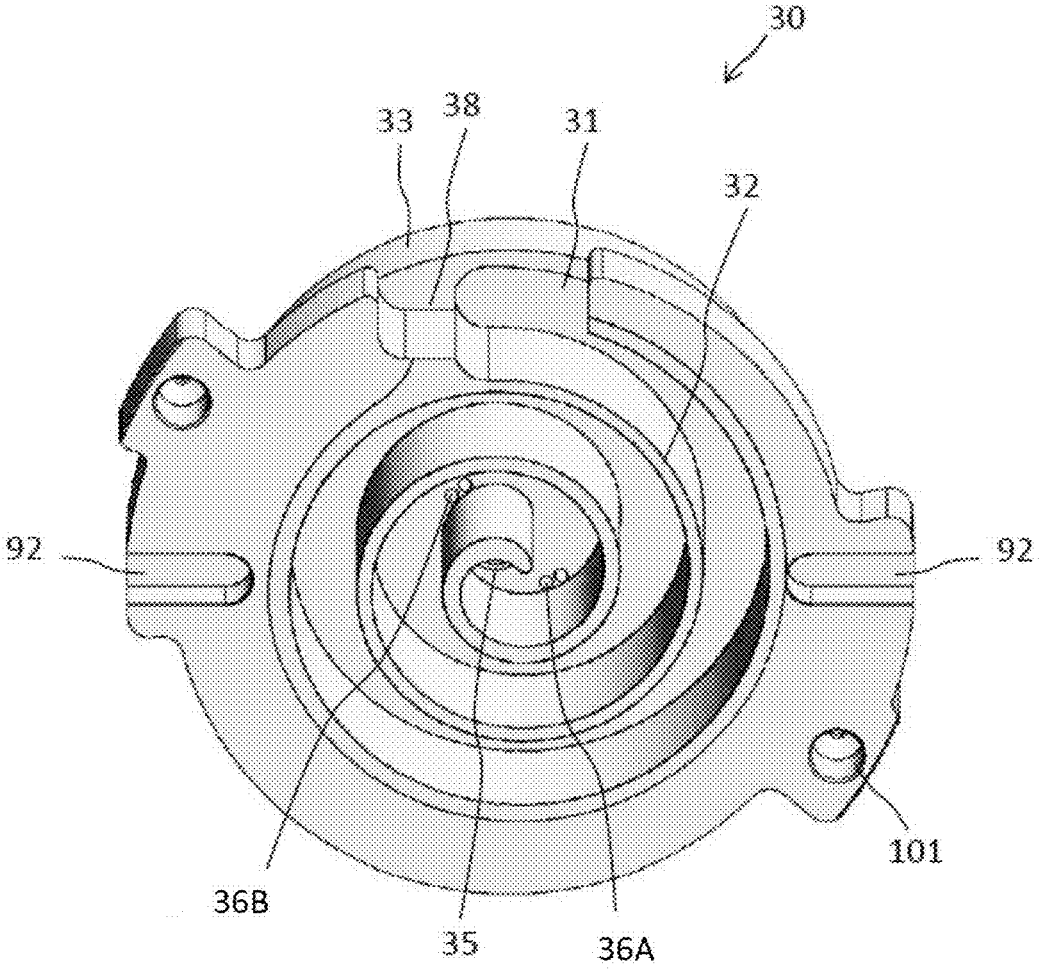

[Fig. 5]
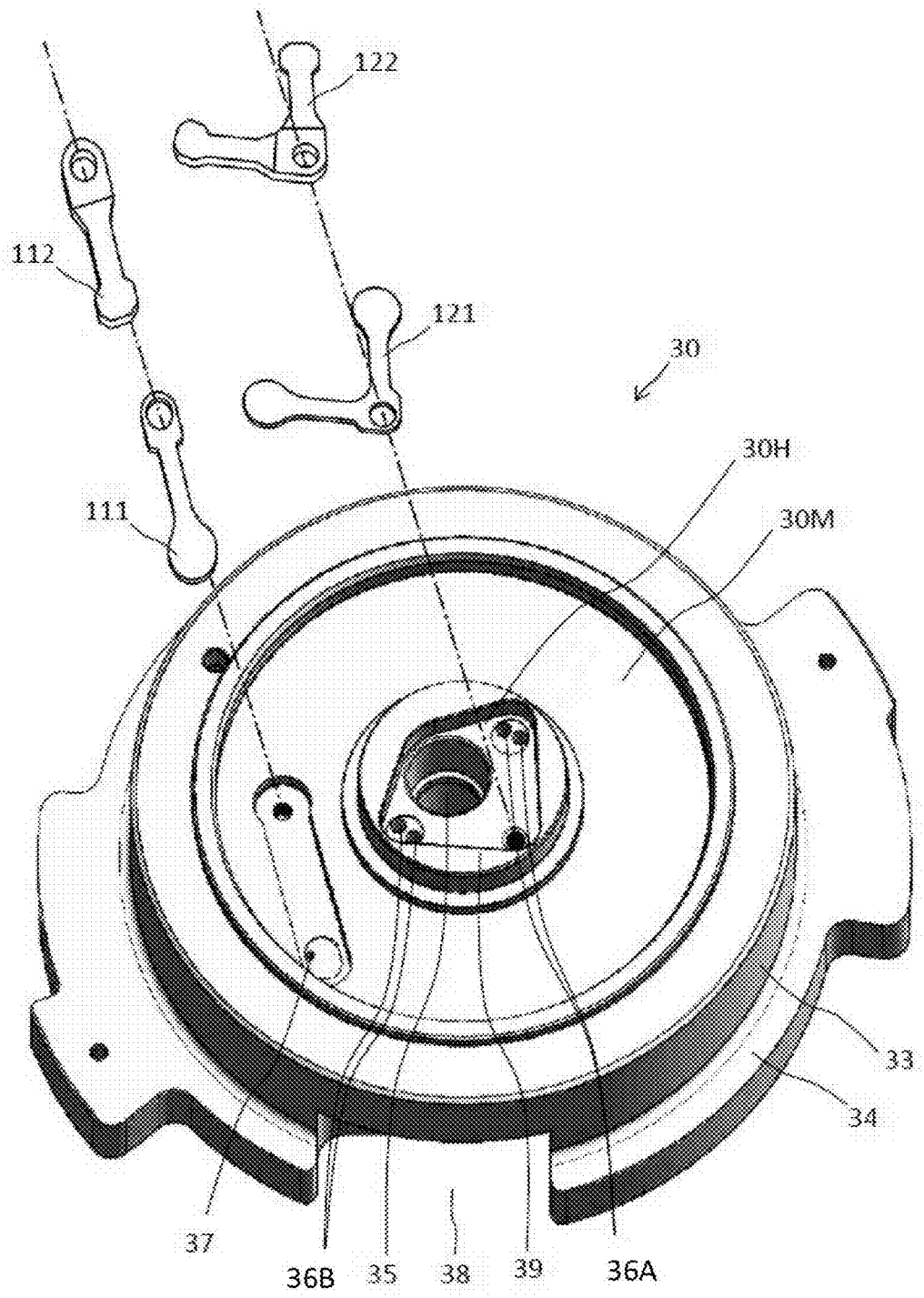

[Fig. 6]
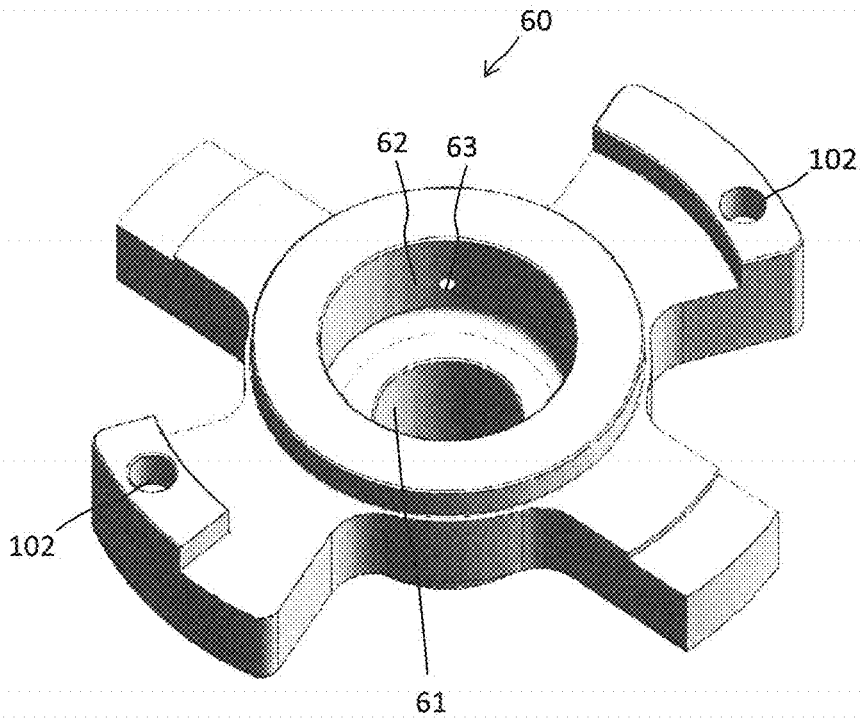

[Fig. 7]
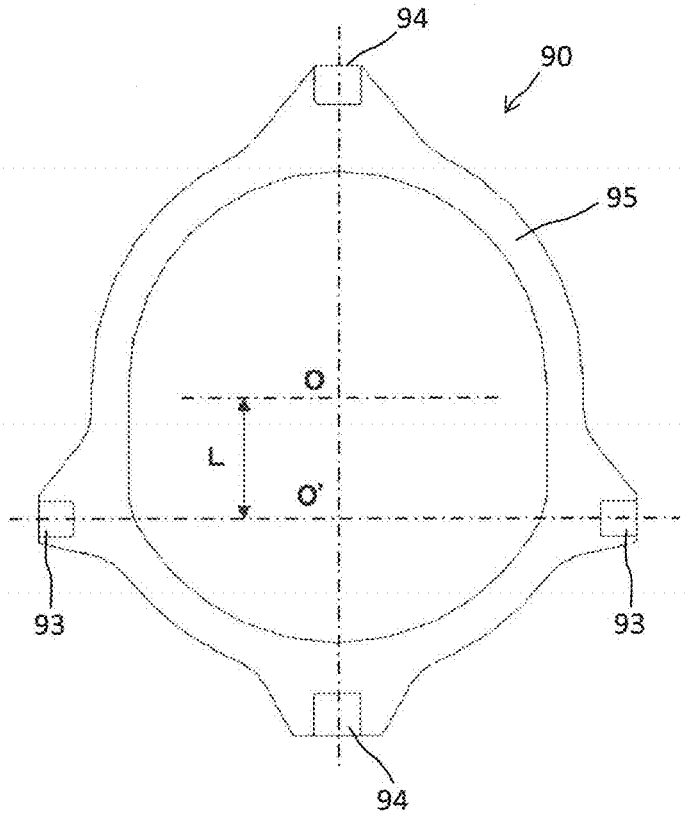

[Fig. 8]
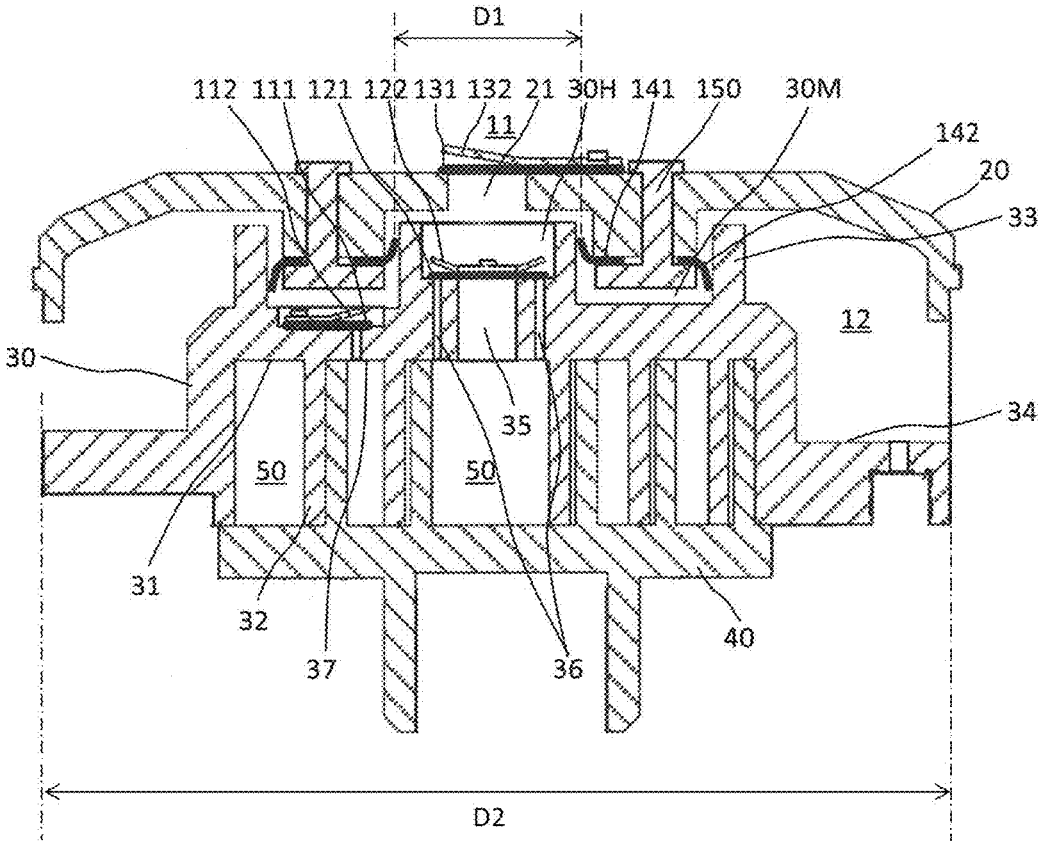

[Fig. 9]
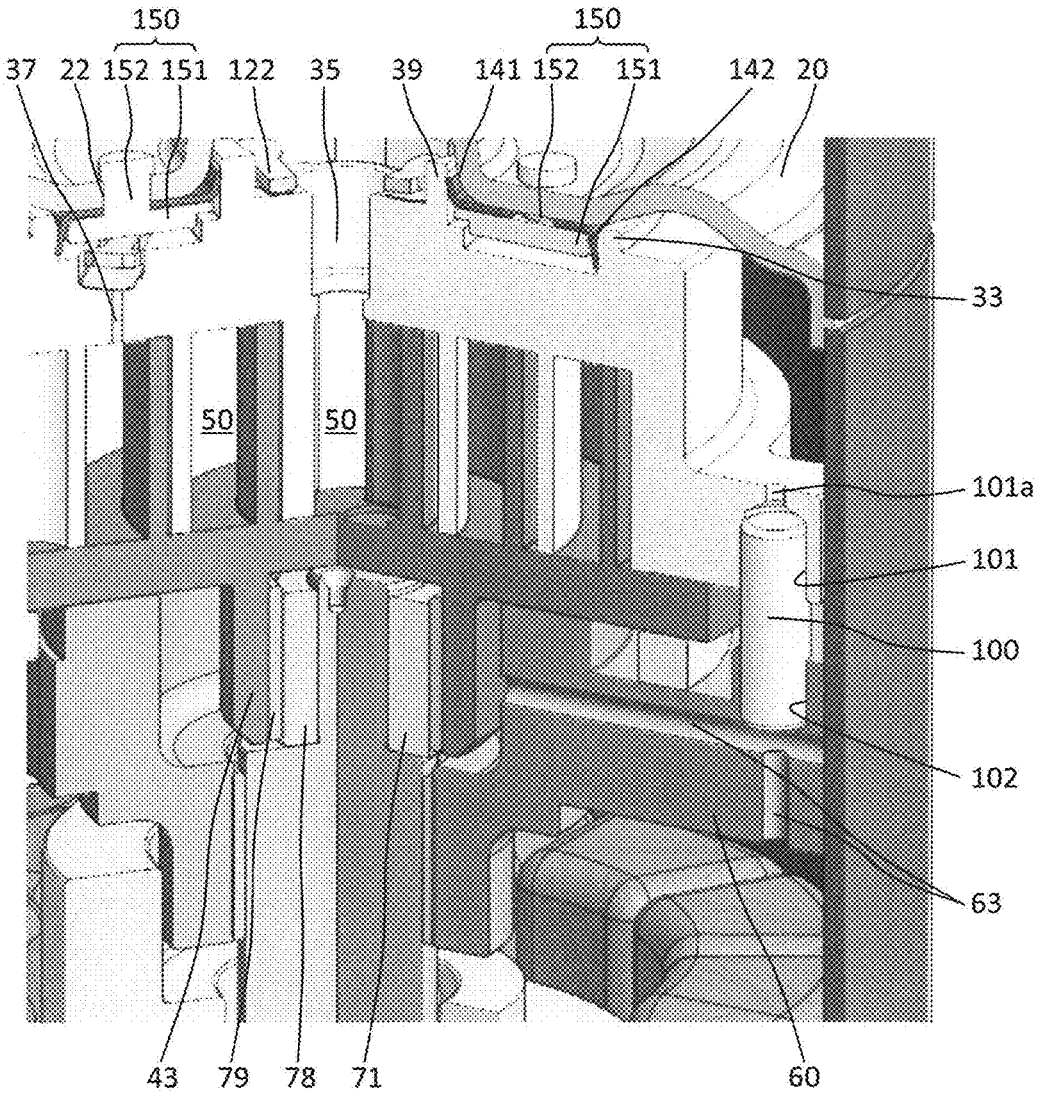

[Fig. 10]
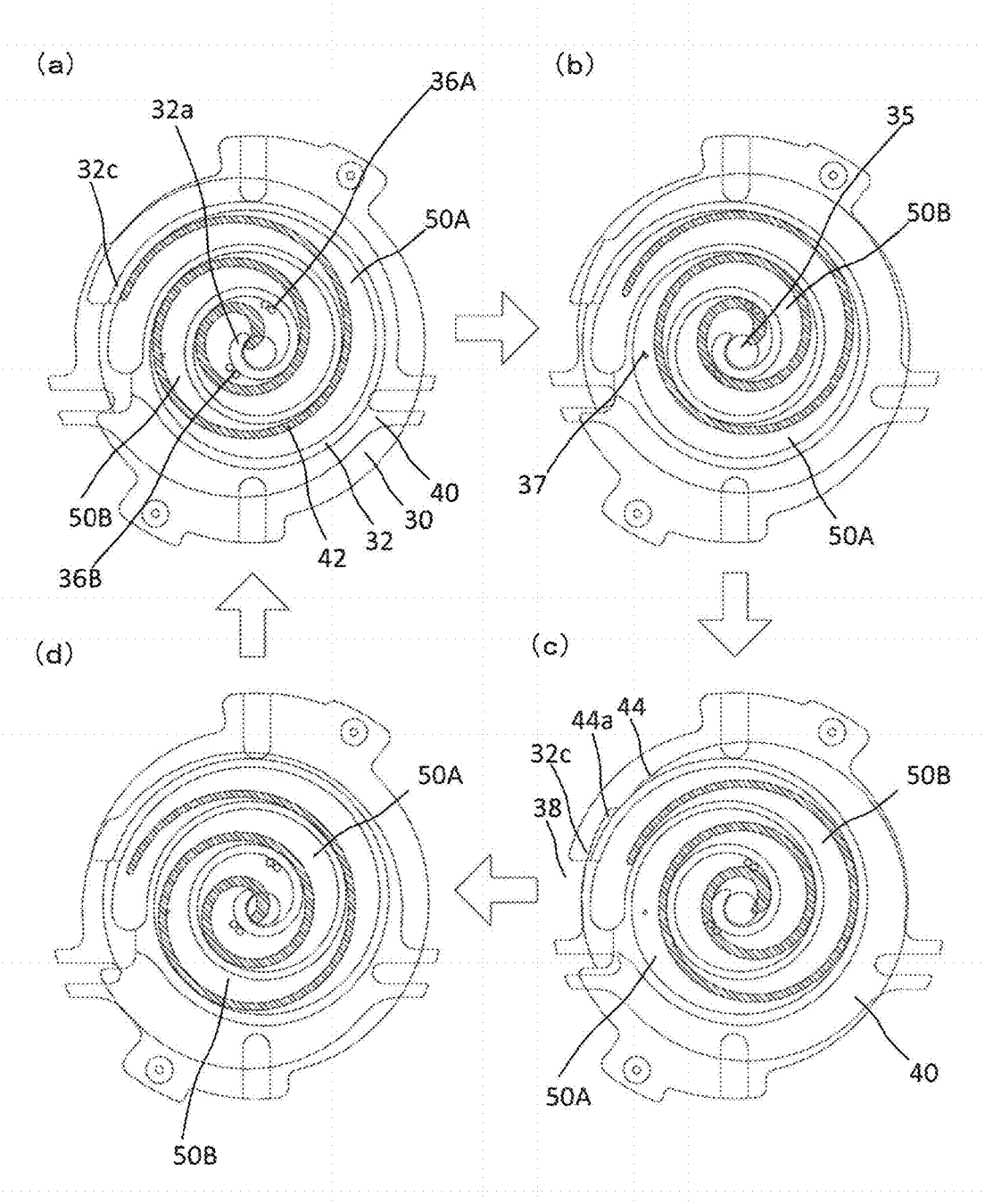

[Fig. 11]
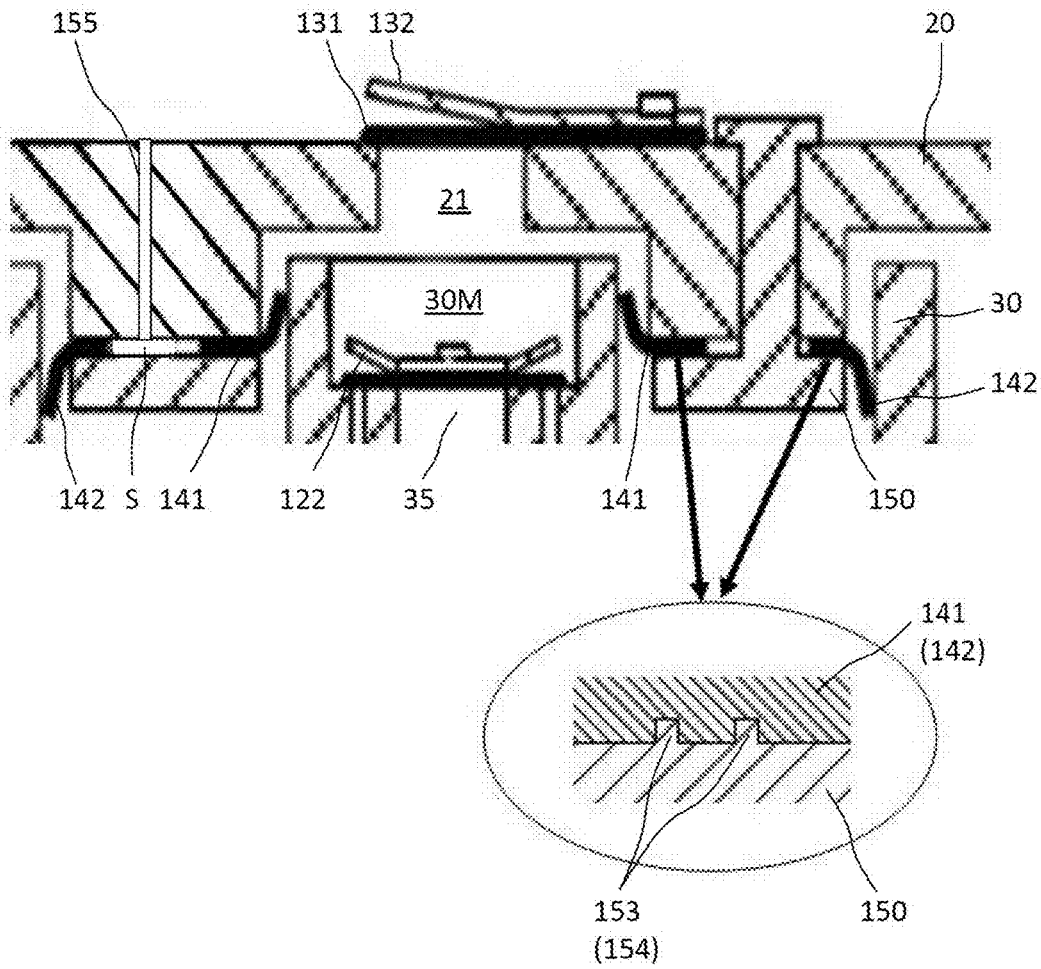

SCROLL COMPRESSOR IN WHICH A FIXED SCROLL AND AN ORBITING SCROLL ARE PLACED BETWEEN A PARTITION PLATE AND A MAIN BEARING

TECHNICAL FIELD

The present invention relates to a scroll compressor.

BACKGROUND TECHNIQUE

In recent years, there is known a hermetic type scroll compressor in which a compression container is provided with a partition plate therein, and a compression element having a fixed scroll and an orbiting scroll and an electric element for orbiting and driving the orbiting scroll are placed in a low-pressure side chamber which is partitioned by this partition plate. As the hermetic type scroll compressor of this kind, there is proposed one in which a boss portion of the fixed scroll is fitted into a holding hole of the partition plate, refrigerant compressed by the compression element is discharged, through a discharge port of the fixed scroll, into a high-pressure side chamber which is partitioned by the partition plate (see patent document 1 for example)

According to the scroll compressor as disclosed in patent document 1, since a space around the compression element is a low pressure space, a force is applied to the scroll compressor and the fixed scroll in directions separating them away from each other.

Therefore, to enhance the hermeticity of the compression chamber formed by the orbiting scroll and the fixed scroll, a chip seal is used in many cases.

PRIOR ART DOCUMENT

Patent Document

[PATENT DOCUMENT 1] Japanese Patent Application Laid-open No. H11-182463

SUMMARY OF THE INVENTION

Problem to be Solved by the Invention

However, to operate the scroll compressor efficiently, it is preferable to apply back pressure to the orbiting scroll or the fixed scroll.

Means for Solving the Problem

Hence, the present invention provides a scroll compressor in which a fixed scroll can move between a partition plate and a main bearing in an axial direction of the fixed scroll, and high pressure is applied to a discharge space formed between the partition plate and the fixed scroll, thereby pressing the fixed scroll against the orbiting scroll.

Further, the present invention provides a scroll compressor capable of forming a medium pressure space between the partition plate and the fixed scroll in addition the high pressure discharge space.

Effect of the Invention

According to the scroll compressor of the present invention, a gap between the fixed scroll and the orbiting scroll can be eliminated, and the scroll compressor can be operated efficiently.

Further, according to the scroll compressor of the invention, since the medium pressure space is formed, it becomes easy to adjust a pressing force of the fixed scroll against the orbiting scroll.

BRIEF DESCRIPTION OF THE DRAWINGS

FIG. 1 is a vertical sectional view showing a configuration of a hermetic type scroll compressor according to an embodiment of the present invention;

FIG. 2(*a*) is a side view of an orbiting scroll of the hermetic type scroll compressor of the embodiment, and FIG. 2(*b*) is a sectional view taken along a line X-X in FIG. 2(*a*);

FIG. 3 is a bottom view showing a fixed scroll of the hermetic type scroll compressor of the embodiment;

FIG. 4 is a perspective view of the fixed scroll as viewed from a bottom surface;

FIG. 5 is a perspective view of the fixed scroll as viewed from an upper surface;

FIG. 6 is a perspective view showing a main bearing of the hermetic type scroll compressor of the embodiment;

FIG. 7 is a top view of a rotation-restraining member of the hermetic type scroll compressor of the embodiment;

FIG. 8 is a sectional view of essential portions showing a partition plate and the fixed scroll of the hermetic type scroll compressor of the embodiment;

FIG. 9 is a partially sectional perspective view showing essential portions of the hermetic type scroll compressor of the embodiment; and FIG. 10 are combined diagrams showing relative positions between the orbiting scroll and the fixed scroll at respective rotation angles of the hermetic type scroll compressor of the embodiment; and FIG. 11 is a sectional view of essential portions showing a first seal member and a second seal member of the hermetic type scroll compressor of the embodiment.

MODE FOR CARRYING OUT THE INVENTION

A first aspect of the present invention provides a scroll compressor including: a partition plate for partitioning an interior of a hermetic container into a high pressure space and a low pressure space; a fixed scroll which is adjacent to the partition plate; an orbiting scroll which is meshed with the fixed scroll and which forms compression chambers; a rotation-restraining member for preventing the orbiting scroll from rotating; and a main bearing for supporting the orbiting scroll, in which the fixed scroll, the orbiting scroll, the rotation-restraining member and the main bearing are placed in the low pressure space, the fixed scroll and the orbiting scroll are placed between the partition plate and the main bearing, the fixed scroll can move in an axial direction of the fixed scroll between the partition plate and the main bearing, wherein the scroll compressor further includes a discharge space which is formed between the partition plate and the fixed scroll, and which is in communication with the compression chamber, a ring-shaped first seal member placed on an outer periphery of the discharge space between the partition plate and the fixed scroll, and ring-shaped second seal member placed on an outer periphery of the first seal member between the partition plate and the fixed scroll, a pressure in a medium pressure space formed between the first seal member and the second seal member is set lower than a pressure in the discharge space and higher than a pressure in the low pressure space, and the first seal member and the second seal member are sandwiched by the partition plate by means of a closing member. According to the first aspect, the medium pressure space is formed between the partition plate and the fixed scroll in addition to the high pressure discharge space. Therefore, it is easy to adjust the pressing force of the fixed scroll against the orbiting scroll. Further, according to the second aspect, since the discharge space and the medium pressure space are formed from the first seal member and the second seal member, it is possible to reduce leakage of refrigerant from the high pressure discharge space to the medium pressure space, and leakage of refrigerant from the medium pressure space to the low pressure space. Furthermore, according to the first aspect, since the first seal member and the second seal member are sandwiched by the partition plate by means of the closing member, after the partition plate, the first seal member, the second seal member and the closing member are assembled, they can be placed in the hermetic container. Therefore, the number of parts can be reduced, and it is easy to assemble the scroll compressor.

According to a second aspect of the invention, in addition to the first aspect, an annular first projection is provided on a contact surface of the closing member with respect to the first seal member, and an annular second projection is provide on a contact surface of the closing member with respect to the second seal member. According to the second aspect, since the first projection crushes the first seal member into an annular shape and the second projection crushes the second seal member into an annular shape, it is possible to enhance sealing performance of the first seal member and the second seal member.

According to a third aspect of the invention, in addition to the first or second aspect, the partition plate is provided with an open hole which brings, into communication with each other, the high pressure space and a closed space, and the closed space is closed by the first seal member, the second seal member, the closing member and the partition plate. According to the third aspect, air trapped in the closed space at the time of manufacture can be released or opened, and it is possible to prevent the vacuum failure at the time of installation.

According to a fourth aspect of the invention, in addition to anyone of the first to third aspects, a first seal diameter of the first seal member is in a range of 10 to 40% of an inner diameter of the hermetic container. According to the fourth aspect, a projection area of the high pressure discharge space in an axial direction of the fixed scroll is made relatively small. Therefore, excessive pressing force caused by a gas force in the high pressure space can be prevented in the axial direction of the fixed scroll leading to the orbiting scroll as viewed from the fixed scroll. Hence, it is possible to realize high efficiency with a wide operating range.

According to a fifth aspect of the invention, in addition to any one of the first to fourth aspects, a medium pressure port which brings the compression chamber into communication with the medium pressure space is formed in the fixed scroll, and a medium pressure check valve capable of closing the medium pressure port is provided. According to the fifth aspect, by utilizing pressure in the compression chamber in the medium pressure space, it is easy to adjust a pressure in the medium pressure space. Further, according to the fifth aspect, since the medium pressure check valve is interposed between the compression chamber and the medium pressure space, it is possible to constantly maintain the pressure in the medium pressure space, and to stably press the fixed scroll against the orbiting scroll.

According to a sixth aspect of the invention, in addition to any one of the first to fifth aspects, a thickness between an inner wall and an outer wall of a fixed spiral lap of the fixed scroll and a thickness between an inner wall and an outer wall of an orbiting spiral lap of the orbiting scroll are gradually reduced from spiral-starting ends toward ending-ends of the fixed spiral lap and the orbiting spiral lap. According to the sixth aspect, by gradually thinning the thickness toward the ending-end, containment capacity of suction gas can be increased, and the spiral lap can be reduced in weight. Hence, a centrifugal force caused by centrifugal whirling of the spiral lap can be reduced. In the scroll compressor of the first aspect, since hermeticity between the fixed scroll and the orbiting scroll is secured by the pressure in the discharge space, it is unnecessary to provide a chip seal on a tip end of the spiral lap. Hence, there is no limitation in the thinness of the spiral lap caused by providing the chip seal, it is possible to thin the spiral lap as in the sixth aspect.

An embodiment of the present invention will be described below with reference to the drawings. The invention is not limited to the following embodiment.

FIG. 1 is a vertical sectional view showing a configuration of a hermetic type scroll compressor according to the embodiment. As shown in FIG. 1, the hermetic type scroll compressor includes a cylindrically formed hermetic container 10 which extends in the vertical direction.

A partition plate 20 is provided at an upper portion in the hermetic container 10 to partition an interior of the hermitic container 10 into upper and lower portions. The partition plate 20 divides the interior of the hermetic container 10 into a high pressure space 11 and a low pressure space 12.

The hermetic container 10 includes a refrigerant suction pipe 13 for introducing refrigerant into the low pressure space 12, and a refrigerant discharge pipe 14 through which compressed refrigerant is discharged from the high pressure space 11. An oil reservoir 15 in which lubricant oil is stored is formed in a bottom of the low pressure space 12.

The low pressure space 12 is provided as a compression mechanism with a fixed scroll 30 and an orbiting scroll 40. The fixed scroll 30 is adjacent to the partition plate 20. The orbiting scroll 40 is meshed with the fixed scroll 30 to form a compression chamber 50.

A main bearing 60 supporting the orbiting scroll 40 is provided below the fixed scroll 30 and the orbiting scroll 40. A bearing portion 61 and a boss-accommodating portion 62 are formed at substantially central portions of the main bearing 60. A return-pipe 63 is formed in the main bearing 60. One end of the return-pipe 63 opens at the boss-accommodating portion 62, and the other end of the return-pipe 63 opens at a lower surface of the main bearing 60. One end of the return-pipe 63 may open at an upper surface of the main bearing 60. The other end of the return-pipe 63 may open at a side surface of the main bearing 60.

The bearing portion 61 pivotally supports a rotation shaft 70.

The rotation shaft 70 is supported by the bearing portion 61 and an auxiliary bearing 16. An eccentric shaft 71 is formed on an upper end of the rotation shaft 70. The eccentric shaft 71 is eccentric from an axis of the rotation shaft 70.

An oil path 72 through which lubricant oil passes is formed in the rotation shaft 70. The rotation shaft 70 is provided at its lower end with a suction port 73 for lubricant oil. A paddle 74 is formed on an upper portion of the suction port 73. The oil path 72 is communication with the suction port 73 and the paddle 74, and is formed in an axial direction of the rotation shaft 70. The oil path 72 is provided with an oil filler 75 for feeding oil to the bearing portion 61, an oil filler 76 for feeding oil to the auxiliary bearing 16, and an oil filler 77 for feeding oil to the boss-accommodating portion 62.

An electric element 80 is composed of a stator 81 fixed to the hermetic container 10 and a rotor 82 placed inside the stator 81.

The rotor 82 is fixed to the rotation shaft 70. Balance weights 17*a* and 17*b* are mounted on the rotation shaft 70 above and below the rotor 82. The balance weights 17*a* and 17*b* are placed at positions deviated from each other 180°. A balance is kept by centrifugal forces caused by the balance weights 17*a* and 17*b* and a centrifugal force generated by revolution of the orbiting scroll 40. The balance weights 17*a* and 17*b* may be fixed to the rotor 82.

A rotation-restraining member (Oldham-ring) 90 prevents the orbiting scroll 40 from rotating. The orbiting scroll 40 is supported by the fixed scroll 30 through the rotation-restraining member 90. According to this, the orbiting scroll 40 does not rotate with respect to the fixed scroll 30 but swirls.

The columnar member 100 prevents the fixed scroll 30 from rotating and moving in a radial direction, and permits movement of the fixed scroll 30 in the axial direction. The fixed scroll 30 is supported by the main bearing 60 by means of the columnar member 100, and the fixed scroll 30 can move in the axial direction between the partition plate 20 and the main bearing 60.

The fixed scroll 30, the orbiting scroll 40, the electric element 80, the rotation-restraining member 90 and the main bearing 60 are placed in the low pressure space 12. The fixed scroll 30 and the orbiting scroll 40 are placed between the partition plate 20 and the main bearing 60.

By a driving operation of the electric element 80, the rotation shaft 70 and the eccentric shaft 71 rotate together with the rotor 82. The orbiting scroll 40 does not rotate by the rotation-restraining member 90 but swirls, and refrigerant is compressed by the compression chamber 50.

Refrigerant is introduced into the low pressure space 12 from the refrigerant suction pipe 13. Refrigerant existing in the low pressure space 12 in outer periphery of the orbiting scroll 40 is introduced into the compression chamber 50. After refrigerant is compressed by the compression chamber 50, the refrigerant is discharged from the refrigerant discharge pipe 14 through the high pressure space 11.

By rotation of the rotation shaft 70, lubricant oil stored in the oil reservoir 15 enters the oil path 72 from the suction port 73, and the lubricant oil is pumped upward along the paddle 74 of the oil path 72. The pumped up lubricant oil is supplied from the oil fillers 75, 76 and 77 to the bearing portion 61, the auxiliary bearing 16 and the boss-accommodating portion 62. Lubricant oil which is pumped up to the boss-accommodating portion 62 is introduced to sliding surfaces between the main bearing 60 and the orbiting scroll 40, and the lubricant oil is discharged through the return-pipe 63 and is again returned to the oil reservoir 15.

FIG. 2(*a*) is a side view of the orbiting scroll of the hermetic type scroll compressor of the embodiment, and FIG. 2(*b*) is a sectional view taken along a line X-X in FIG. 2(*a*).

The orbiting scroll 40 includes a disk-like orbiting scroll panel 41, a spiral-shaped orbiting spiral lap 42 standing on an upper surface of the orbiting scroll panel 41, and a cylindrical boss 43 formed at a substantially central portion of a lower surface of the orbiting scroll panel 41.

A thickness between an inner wall and an outer wall of the orbiting spiral lap 42 is gradually thinned from a spiral-starting end 42*a* to an ending-end 42*b* of the orbiting spiral lap 42. By gradually thinning the orbiting spiral lap 42 toward the ending-end 42*b* in this manner, a containment capacity of suction gas can be made large and the orbiting spiral lap 42 can be light in weight. Therefore, a centrifugal force caused by centrifugal whirling of the orbiting spiral lap 42 can be reduced.

In FIG. 2(*b*), an edge portion 44 on the side of an end surface where the orbiting spiral lap 42 of the orbiting scroll panel 41 is formed is shown by a thick solid line. A convex portion 44*a* is formed on the edge portion 44. The convex portion 44*a* is provided in the vicinity of the ending-end 42*b*. A pair of first key grooves 91 are formed in the orbiting scroll panel 41.

FIG. 3 is a bottom view showing the fixed scroll of the hermetic type scroll compressor of the embodiment, FIG. 4 is a perspective view of the fixed scroll as viewed from a bottom surface, and FIG. 5 is a perspective view of the fixed scroll as viewed from an upper surface.

The fixed scroll 30 includes a disk-shaped fixed scroll panel 31, a spiral-shaped fixed spiral lap 32 standing on a lower surface of the fixed scroll panel 31, a peripheral wall 33 standing to surround a periphery of the fixed spiral lap 32, and a flange 34 provided around the peripheral wall 33.

A thickness between an inner wall and an outer wall of the fixed spiral lap 32 is gradually thinned from a spiral-starting end 32*a* to an ending-end 32*b* of the fixed spiral lap 32. Here, the ending-end 32*b* is a portion where the fixed spiral lap 32 is formed from the inner wall and the outer wall, and only the inner wall of the fixed spiral lap 32 extends from the ending-end 32*b* to an inner wall most outer peripheral portion 32*c* by about 340°. By gradually thinning the fixed spiral lap 32 toward the ending-end 32*b* in this manner, a containment capacity of suction gas can be made large and the fixed spiral lap 32 can be light in weight. Therefore, a centrifugal force caused by centrifugal whirling of the fixed spiral lap 32 can be reduced.

A first discharge port 35 is formed in a substantially center portion of the fixed scroll panel 31. A bypass port 36 and a medium pressure port 37 are formed in the fixed scroll panel 31. The bypass port 36 is located in the vicinity of the first discharge port 35 and in a high pressure region immediately before compression is completed. The medium pressure port 37 is located in a medium pressure region halfway through compression.

The fixed scroll panel 31 projects higher than the flange 34.

A suction portion 38 is formed in the peripheral wall 33 and the flange 34 of the fixed scroll 30. Refrigerant is taken into the compression chamber 50 through the suction portion 38. A second key groove 92 is formed in the flange 34.

A scroll-side concave portion 101 into which an upper end of the columnar member 100 is inserted is formed in the flange 34.

As shown in FIG. 5, a boss portion 39 is formed on a central portion of an upper surface (surface on the side of partition plate 20) of the fixed scroll 30. A discharge space 30H is formed in the boss portion 39 by a concave portion. The first discharge port 35 and the bypass port 36 are formed in the discharge space 30H.

A ring-shaped concave portion is formed in an upper surface of the fixed scroll 30 between the peripheral wall 33 and the boss portion 39. By this ring-shaped concave portion, a medium pressure space 30M is formed. A pressure in the medium pressure space 30M is lower than that in the discharge space 30H and higher than that in the low pressure space 12. The medium pressure port 37 is formed in the medium pressure space 30M. The medium pressure port 37 has a diameter smaller than a thickness between the inner wall and the outer wall of the orbiting spiral lap 42. By making the diameter of the medium pressure port 37 smaller than the thickness between the inner wall and the outer wall of the orbiting spiral lap 42, it is possible to prevent the communication between the compression chamber 50 formed on the side of the inner wall of the orbiting spiral lap 42 and the compression chamber 50 formed on the side of the outer wall of the orbiting spiral lap 42.

The medium pressure space 30M is provided with a medium pressure check valve 111 capable of closing the medium pressure port 37, and a medium pressure check valve stop 112. If a reed valve is used as the medium pressure check valve 111, a height of the medium pressure check valve 111 can be lowered. The medium pressure check valve 111 may be composed of a ball valve and a spring.

The discharge space 30H is provided with a bypass check valve 121 capable of closing the bypass port 36, and a bypass check valve stop 122. If a reed valve type check valve is used as the bypass check valve 121, a height of the bypass check valve 121 can be lowered. If a V-shaped reed valve type check valve is used as the bypass check valve 121, it is possible to close, by one reed valve, bypass ports 36A which are in communication with the compression chamber 50 formed on the side of the outer wall of the orbiting spiral lap 42, and bypass ports 36B which are in communication with the compression chamber 50 formed on the side of the inner wall of the orbiting spiral lap 42.

A shape of the orbiting spiral lap 42 of the orbiting scroll 40 shown in FIG. 2 and a shape of the fixed spiral lap 32 of the fixed scroll 30 shown in FIG. 3 will be described below.

The inner and outer wall curves of the fixed spiral lap 32 and the orbiting spiral lap 42 are expressed in the following equations, wherein basic radius is a, involute angle is θ, swirl radius is ϵ, and B and n are coefficients:

$$xo=a\cdot\cos\theta+(a\cdot\theta-B\cdot\theta n)\cdot\sin\theta \text{ (outer wall } X \text{ coordinate)}$$

$$yo=a\cdot\sin\theta-(a\cdot\theta-B\cdot\theta n)\cdot\cos\theta \text{ (outer wall } Y \text{ coordinate)}$$

$$xi=a\cdot\cos\theta+(a\cdot(\theta-\pi)-B\cdot(\theta-\pi)n+\epsilon)\cdot\sin\theta \text{ (inner wall } X \text{ coordinate)}$$

$$yi=a\cdot\sin\theta-(a\cdot(\theta-\pi)-B\cdot(\theta-\pi)n+\epsilon)\cdot\cos\theta \text{ (inner wall } Y \text{ coordinate)}$$

and coefficient B satisfies B>0.

According to such a configuration, since the winding-end thicknesses of the fixed spiral lap 32 and the orbiting spiral lap 42 can be made small, the fixed scroll 30 and the orbiting scroll 40 can be reduced in weight. It is possible to reduce a load of the bearing portion 61 by a centrifugal force-reducing effect especially when the orbiting scroll 40 swirls and drives by the weight-lightening. Further, since the balance weights 17*a* and 17*b* provided on the rotation shaft 70 can be made compact, it is possible to enhance the flexibility of design. Further, since the involute angle can be design large as compared with a conventional spiral lap shape, the compression ratio and capacity can be increased. Hence, efficiency of the scroll compressor can be enhanced and a size thereof can be reduced.

According to the scroll compressor of the embodiment, since hermeticity of the fixed scroll 30 and the orbiting scroll 40 is secured by a pressure of the discharge space 30H, it is unnecessary to provide chip seals on tip ends of the fixed spiral lap 32 and the orbiting spiral lap 42. Therefore, thinness of each of the fixed spiral lap 32 and the orbiting spiral lap 42 is not limited by providing the chip seal, the fixed spiral lap 32 and the orbiting spiral lap 42 can be thinned.

FIG. 6 is a perspective view showing a main bearing of the hermetic type scroll compressor of the embodiment.

The bearing portion 61 and the boss-accommodating portion 62 are formed at substantially central portions of the main bearing 60.

Bearing-side concave portions 102 into which lower end of the columnar members 100 are inserted are formed in the outer periphery of the main bearing 60.

It is preferable that a bottom surface of each of the bearing-side concave portions 102 is in communication with the return-pipes 63. In this case, lubricant oil is supplied to the bearing-side concave portions 102 by the return-pipe 63, and it is possible to enhance the reliability of a fitted state between the columnar member 100 and the scroll-side concave portion 101 and a fitted state between the columnar member 100 and the bearing-side concave portions 102.

FIG. 7 is a top view of the rotation-restraining member of the hermetic type scroll compressor of the embodiment.

First kys 93 and second keys 94 are formed on the rotation-restraining member (Oldham-ring) 90. The first keys 93 engage with the first key grooves 91 of the orbiting scroll 40, and the second keys 94 engage with the second key grooves 92 of the fixed scroll 30. Therefore, the orbiting scroll 40 can swirl without rotating with respect to the fixed scroll 30. As shown in FIG. 1, the fixed scroll 30, the orbiting scroll 40 and an Oldham-ring 90 are placed in this order from above in the axial direction of the rotation shaft 70. Since the fixed scroll 30, the orbiting scroll 40 and the Oldham-ring 90 are placed in this order, the first keys 93 and the second keys 94 of the Oldham-ring 90 are formed on the same plane of a ring portion 95. Hence, when the Oldham-ring 90 is machined, it is possible to machine the first keys 93 and the second keys 94 from the same direction, and to reduce the attaching and detaching times of the Oldham-ring 90 from a machining device. Therefore, it is possible to enhance the machining precision and to reduce machining costs.

Further, the Oldham-ring 90 is formed such that a phantom intersection O' between a first phantom line which connects centers of the pair of first keys with each other 93 and a second phantom line which connects centers of the pair of second keys 94 with each other is deviated from a middle point O (middle point of most end of second key 94 in radial direction) of the second phantom line by a distance L. By employing such a configuration, since the first key grooves 91 of the orbiting scroll 40 can be deviated from a center of the orbiting scroll panel 41 as shown in FIG. 2, a distance between the first key grooves 91 and the orbiting spiral lap 42 can be increased. As a result, since a distance between the center of the orbiting scroll panel 41 and the ending-end 42*b* of the orbiting spiral lap 42 can be made long, the involute angle of the orbiting spiral lap 42 can be made large. Hence, it is easy to increase the compression ratio and the capacity, and it is possible to further enhance the efficiency of the scroll compressor and to make the scroll compressor compact.

FIG. 8 is a sectional view of essential portions showing the partition plate and the fixed scroll of the hermetic type scroll compressor of the embodiment.

A second discharge port 21 is formed in a center of the partition plate 20. The second discharge port 21 is provided with a discharge check valve 131 and a discharge check valve stop 132.

The discharge space 30H which is in communication with the first discharge port 35 is formed between the partition plate 20 and the fixed scroll 30. A check valve is not provided between the first discharge port 35 and the discharge space 30H. The second discharge port 21 brings the discharge space 30H into communication with the high pressure space 11. The discharge check valve 131 closes the second discharge port 21.

According to this embodiment, a high pressure is applied to the discharge space 30H formed between the partition plate 20 and the fixed scroll 30. According to this, since the fixed scroll 30 is pressed against the orbiting scroll 40, a gap between the fixed scroll 30 and the orbiting scroll 40 can be eliminated, and the scroll compressor can be operated efficiently. Since the high pressure is applied to the discharge space 30H, it is important that the axial projection area of the discharge space 30H is reduced as small as possible, the fixed scroll 30 is prevented from excessively pressing against the orbiting scroll 40, and the reliability is enhanced. However, if the axial projection area of the discharge space 30H is reduced, it becomes difficult to place the check valves on both the first discharge port 35 and the bypass port 36. Especially when the check valve of the first discharge port 35 and the check valve of the bypass port 36 are placed on the same plane, it inevitably becomes necessary to increase the axial projection area of the discharge space 30H. Hence, in this embodiment, the check valve is not placed in the first discharge port 35, and the discharge check valve 131 is placed in the second discharge port 21. According to this, the axial projection area of the discharge space 30H can be made small, and it is possible to prevent the fixed scroll 30 from excessively being pressed against the orbiting scroll 40.

According to the embodiment, the compression chamber 50 and the discharge space 30H are brought into communication with each other by the bypass port 36 in addition to the first discharge port 35, and the bypass port 36 is provided with the bypass check valve 121. Hence, refrigerant is from the discharge space 30H is prevented from reversely flowing, and the refrigerant can be introduced to the discharge space 30H when a pressure reaches a predetermined value. Therefore, it is possible to realize high efficiency with a wide operating range.

A spring constant of the discharge check valve 131 is greater than that of the bypass check valve 121. To make the spring constant of the discharge check valve 131 greater than that of the bypass check valve 121, a thickness of the discharge check valve 131 is made thicker than the bypass check valve 121 for example.

An average flow path area of the second discharge port 21 is made greater than that of the first discharge port 35. Since refrigerant passing through the first discharge port 35 and refrigerant passing through the bypass port 36 flow into the second discharge port 21, if the average flow path area of the second discharge port 21 is made greater than that of the first discharge port 35, it is possible to reduce a loss of a discharge pressure.

A port inlet of the second discharge port 21 on the side of the discharge space 30H is chamfered, and an end surface of the port inlet is chamfered. According to this, a loss of the discharge pressure can be reduced.

The hermetic type scroll compressor of the embodiment includes, between the partition plate 20 and the fixed scroll 30, a ring-shaped first seal member 141 placed on an outer periphery of the discharge space 30H and a ring-shaped second seal member 142 placed on an outer periphery of the first seal member 141.

Polytetrafluoroethylene which is fluorine resin is suitable as the first seal member 141 and the second seal member 142 in terms of sealing performance and assembling performance. If fiber material is mixed in the fluorine resin, sealing reliability of the first seal member 141 and the second seal member 142 is enhanced.

The first seal member 141 and the second seal member 142 are sandwiched by the partition plate 20 by means of closing members 150. If aluminum material is used as the closing member 150, it is possible to swage the partition plate 20 with respect to the closing member 150.

The medium pressure space 30M is formed between the first seal member 141 and the second seal member 142. By the medium pressure port 37, the medium pressure space 30M is in communication with the compression chamber 50 which is located in a medium pressure region halfway through compression. Therefore, a pressure which is lower than that of the discharge space 30H and higher than that of the low pressure space 12 is applied to the medium pressure space 30M.

According to this embodiment, by forming the medium pressure space 30M between the partition plate 20 and the fixed scroll 30 in addition to the high pressure discharge space 30H, it is easy to adjust a pressing force of the fixed scroll 30 against the orbiting scroll 40.

According to this embodiment, since the first seal member 141 and the second seal member 142 form the discharge space 30H and the medium pressure space 30M, it is possible to reduce leakage of refrigerant from the high pressure discharge space 30H to the medium pressure space 30M, and leakage of refrigerant from the medium pressure space 30M to the low pressure space 12.

According to this embodiment, the first seal member 141 and the second seal member 142 are sandwiched by the partition plate 20 by means of the closing member 150, and after the partition plate 20, the first seal member 141, the second seal member 142 and the closing member 150 are assembled, they can be placed in the hermetic container 10. Hence, the number of parts can be reduced, and it is easy to assemble the scroll compressor.

According to this embodiment, the medium pressure port 37 which brings the compression chamber 50 into communication with the medium pressure space 30M is formed in the fixed scroll 30, and the medium pressure check valve 111 capable of closing the medium pressure port 37 is provided. Therefore, by utilizing a pressure of the compression chamber 50 in the medium pressure space 30M, it is easy to adjust the pressure in the medium pressure space 30M.

According to this embodiment, since the medium pressure check valve 111 is interposed between the compression chamber 50 and the medium pressure space 30M, it is possible to constantly maintain the pressure in the medium pressure space 30M, and it is possible to stably press the fixed scroll 30 against the orbiting scroll 40.

FIG. 9 is a partially sectional perspective view showing essential portions of the hermetic type scroll compressor of the embodiment.

As shown in FIG. 9, each of the closing members 150 described with respect to FIG. 8 is composed of a ring-shaped member 151 and a plurality of projections 152 formed on one of surfaces of the ring-shaped member 151.

An outer periphery of the first seal member 141 is sandwiched between an inner peripheral upper surface of the ring-shaped member 151 and the partition plate 20. An inner periphery of the second seal member 142 is sandwiched between an outer peripheral upper surface of the ring-shaped member 151 and the partition plate 20.

The ring-shaped member 151 is mounted on the partition plate 20 in a state where the ring-shaped member 151 sandwiches the first seal member 141 and the second seal member 142.

The closing member 150 is mounted on the partition plate 20 in such a manner that the projection 152 is inserted into a hole 22 formed in the partition plate 20, the ring-shaped member 151 is pressed against the lower surface of the partition plate 20 and in this state, an end of the projection 152 is swaged and fixed.

In a state where the closing member 150 is mounted on the partition plate 20, an inner periphery of the first seal member 141 projects toward the inner periphery of the ring-shaped member 151, and an outer periphery of the second seal member 142 projects toward the outer periphery of the ring-shaped member 151.

By attaching the partition plate 20 on which the closing member 150 is mounted into the hermetic container 10, the inner periphery of the first seal member 141 is pressed against an outer peripheral surface of the boss portion 39 of the fixed scroll 30, and an outer periphery of the second seal member 142 is pressed against an inner peripheral surface of the peripheral wall 33 of the fixed scroll 30.

The bearing-side concave portion 102 is formed in the upper surface of the outer periphery of the main bearing 60, and the scroll-side concave portion 101 is formed in the lower surface of the outer periphery of the fixed scroll 30.

A lower end of the columnar member 100 is inserted into the bearing-side concave portion 102, and an upper end of the columnar member 100 is inserted into the scroll-side concave portion 101.

The columnar member 100 can slide with at least one of the bearing-side concave portion 102 and the scroll-side concave portion 101. According to this, the fixed scroll 30 can move in the axial direction between the partition plate 20 and the main bearing 60.

A bottom surface of the bearing-side concave portion 102 is in communication with an exterior of the main bearing 60 through the return-pipe 63, and a bottom of the scroll-side concave portion 101 is in communication with an exterior of the fixed scroll 30 through a communication hole 101*a*.

According to this embodiment, the scroll-side concave portion 101, the bearing-side concave portion 102 and the columnar member 100 can prevent the fixed scroll 30 from rotating and moving in the radial direction, and can permit the fixed scroll 30 to move in the axial direction.

The eccentric shaft 71 is inserted into the boss 43 through a swing bush 78 and a swirl bearing 79 such that the eccentric shaft 71 can swirl and drive. According to this configuration, the swing bush 78 functions as a compliance mechanism in a centrifugal direction in an orbiting motion at the time of operation. When the orbiting scroll 40 is displaced in the centrifugal direction and the orbiting scroll 40 is pressed against the fixed scroll 30, a gap between the orbiting spiral lap 42 and the fixed spiral lap 32 is minimized, and leakage of refrigerant from the gap can be reduced.

Further, since the bypass port 36 is provided, excessive compression can be reduced and correspondingly, a force in the centrifugal direction which is necessary to overcome a gas force in the compression chamber 50 is reduced. Therefore, it is possible to design so that the orbiting scroll 40 is always pressed against the fixed scroll 30 with wide operation range.

If the orbiting scroll 40 is designed such that it is pressed against the fixed scroll 30 even under the excessive compression condition where a compression load is large, since the orbiting scroll 40 is excessively pressed against the fixed scroll 30 under a condition that the compression load is low, a mechanical loss is increased and reliability is deteriorated. However, if the bypass port 36 is provided, since the excessive compression can be suppressed, it is possible to reduce a difference between a force in the centrifugal direction under the condition that the compression load is large and a force in the centrifugal direction under the condition that the compression load is low, and it is possible to obtain high efficiency and high reliability with a wide operation range.

FIG. 10 are combined diagrams showing relative positions between the orbiting scroll and the fixed scroll at respective rotation angles of the hermetic type scroll compressor of the embodiment.

A compression chamber 50A is formed from an outer wall of the orbiting spiral lap 42 of the orbiting scroll 40 and an inner wall of the fixed spiral lap 32 of the fixed scroll 30. A compression chamber 50B is formed from an inner wall of the orbiting spiral lap 42 of the orbiting scroll 40 and an outer wall of the fixed spiral lap 32 of the fixed scroll 30.

FIG. 10(*a*) shows a state immediately after the suction and closing operation of the compression chamber 50A is completed.

FIG. 10(*b*) shows a state where rotation proceeds from FIG. 10(*a*) 90°, FIG. 10(*c*) shows a state where rotation proceeds from FIG. 10(*b*) 90°, and FIG. 10(*d*) shows a state where rotation proceeds from FIG. 10(*c*) 90°, and if rotation proceeds from FIG. 10(*d*) 90°, the state returns to the state of FIG. 10(*a*).

FIG. 10(*c*) shows a state immediately after the compression chamber 50B sucks and closes.

The compression chamber 50A which completes the suction and closing operation in FIG. 10(*a*) moves toward a center of the fixed scroll 30 while reducing the capacity as shown in FIGS. 10(*b*), (*c*) and (*d*), and the compression chamber 50A is brought into communication with the first discharge port 35 until the compression chamber 50A reaches FIG. 10(*d*) from FIG. 10(*c*) where rotation proceeds 540°. The first bypass ports 36A bring the compression chamber 50A into communication with the discharge space 30H before the compression chamber 50A which completes the suction and closing operation in FIG. 10(*a*) is brought into communication with the first discharge port 35. Therefore, when a pressure in the compression chamber 50A becomes a pressure for pushing up the bypass check valve 121, refrigerant in the compression chamber 50A is introduced into the discharge space 30H from the first bypass ports 36A before the compression chamber 50A is brought into communication with the first discharge port 35.

The compression chamber 50B which completes the suction and closing operation in FIG. 10(*c*) moves toward the center of the fixed scroll 30 while reducing the capacity as shown in FIGS. 10(*d*), (*a*) and (*b*), and the compression chamber 50B is brought into communication with the first discharge port 35 until the compression chamber 50B reaches FIG. 10(*d*) from FIG. 10(*c*) where rotation proceeds 360°. The second bypass ports 36B bring the compression chamber 50B into communication with the discharge space 30H before the compression chamber 50B which completes the suction and closing operation in FIG. 10(*c*) is brought into communication with the first discharge port 35. Therefore, when a pressure in the compression chamber 50B becomes a pressure for pushing up the bypass check valve 121, refrigerant in the compression chamber 50B is introduced into the discharge space 30H from the second bypass ports 36B before the compression chamber 50B is brought into communication with the first discharge port 35.

The compression chambers 50A and 50B and the discharge space 30H are brought into communication with each other through the first bypass ports 36A and the second bypass ports 36B in addition to the first discharge port 35, and the first bypass ports 36A and the second bypass ports 36B are provided with the bypass check valve 121. According to this, it is possible to prevent refrigerant from the discharge space 30H from reversely flowing, and refrigerant can be introduced into the discharge space 30H when a pressure reaches a predetermined value. Hence, it is possible to realize high efficiency with a wide operating range.

As shown in FIGS. 10(*a*) to (*d*), the medium pressure port 37 is provided at a position where it is brought into communication with the compression chamber 50A after the suction and closing operation is completed in FIG. 10(*a*) and with the compression chamber 50B after the suction and closing operation is completed in FIG. 10(*c*).

As shown in FIG. 10(*c*), the orbiting scroll 40 is separated furthest from the suction portion 38 at a position where rotation proceeds 180° from FIG. 10(*a*). At this position, the edge portion 44 of the orbiting scroll 40 and the inner wall most outer peripheral portion 32*c* of the fixed scroll 30 come closest to each other. According to the scroll compressor of this embodiment, however, since the convex portion 44*a* is provided to widen a portion of an outer diameter of the orbiting scroll panel 41 of the orbiting scroll 40 radially outward, the edge portion 44 of the orbiting scroll 40 can always cover the inner wall most outer peripheral portion 32*c* of the fixed scroll 30 as viewed from the rotation shaft 70 while the orbiting scroll 40 swirls and drives. That is, a contour (outline) of the edge portion 44 of the orbiting scroll panel 41 of the orbiting scroll 40 can always exceed (extend beyond) the inner wall most outer peripheral portion 32*c* of the fixed scroll 30 outward. Hence, even when the orbiting scroll 40 bends or falls at the time of operation, a stable driving state can always be held without partial contact between the inner wall most outer peripheral portion 32*c* of the fixed scroll 30 and the edge portion 44 of the orbiting scroll 40, and high reliability can be realized.

By providing the convex portion 44*a* at a position superposed on the suction portion 38 in the axial direction, a necessary region of the convex portion 44*a* can be minimized, and an effect caused by further reducing the weight can be obtained.

In this embodiment, the convex portion 44*a* is provided to widen the portion of the outer diameter of the orbiting scroll panel 41 of the orbiting scroll 40 radially outward. According to this, the edge portion 44 of the orbiting scroll 40 can always cover the inner wall most outer peripheral portion 32*c* of the fixed scroll 30 as viewed from the rotation shaft 70 while the orbiting scroll 40 swirls and drives. As another configuration, it is possible to employ such a configuration that an involute angle of the spiral-starting end of the inner wall of the fixed scroll 30 is decreased in size, and the inner wall is terminated at a position closer to the central portion of the panel with respect to a radial direction of the fixed scroll 30. According to this configuration, however, the containment capacity is reduced. Therefore, in order to realize the same capacity, it is necessary to increase the heights of the fixed spiral lap 32 and the orbiting spiral lap 42. Hence, since the orbiting spiral lap 42 and the fixed spiral lap 32 become tall, there is fear that deterioration in reliability of the spiral lap, deterioration of a bearing force against overturn and deterioration in machining performance are generated. Further, since the compression ratio is also lowered, insufficient compression easily occurs, and there is fear that efficiency of the compressor is deteriorated.

Further, also by increasing the entire outer diameter of the orbiting scroll panel 41 of the orbiting scroll 40, the edge portion 44 of the orbiting scroll 40 can always cover the inner wall most outer peripheral portion 32*c* of the fixed scroll 30 as viewed from the rotation shaft 70 while the orbiting scroll 40 swirls and drives. However, the maximum outer diameter of the orbiting scroll panel 41 of the orbiting scroll 40 can be designed only within such a range that the orbiting scroll panel 41 does not come into contact with the columnar member 100 which supports the fixed scroll 30 by the main bearing 60. Hence, in order to increase the outer diameter of the orbiting scroll panel 41 of the orbiting scroll 40, it is necessary to reduce the columnar member 100 in size. Therefore, there is fear that rigidity of the columnar member 100 which supports the fixed scroll 30 by the main bearing 60 is deteriorated.

Due to such reasons, it is possible to realize high reliability and high efficiency by the configurations of the scroll compressor of the embodiment.

In this embodiment, the inner wall of the fixed spiral lap 32 of the fixed scroll 30 is formed up to a location close to the ending-end 32*b* of the orbiting spiral lap 42 of the orbiting scroll 40. According to this, the containment capacity of the compression chamber 50A formed from the inner wall of the fixed spiral lap 32 and the outer wall of the orbiting spiral lap 42, and the containment capacity of the compression chamber 50B formed from the outer wall of the fixed spiral lap 32 and the inner wall of the orbiting spiral lap 42 are made different from each other.

According to this embodiment, by securing the maximum containment capacity of the suction gas, the compression ratio can be increased. Therefore, the heights of the fixed spiral lap 32 and the orbiting spiral lap 42 can be lowered. Thus, the fixed scroll 30 can move in the axial direction between the partition plate 20 and the main bearing 60. In the scroll compressor in which the fixed scroll 30 is pressed against the orbiting scroll 40 by the pressure of the discharge space 30H and the hermeticity between the fixed scroll 30 and the orbiting scroll 40 is secured, if the heights of the fixed spiral lap 32 and the orbiting spiral lap 42 are lower, it is possible to more stabilize the fixed scroll 30.

In this embodiment, the suction and containment position in the compression chamber 50A and the suction and containment position in the compression chamber 50B are provided in the vicinity of the suction portion 38. According to this, a length of a sucked refrigerant passage can be made shortest, and a heat reception loss can be reduced.

When the suction and containment position in the compression chamber 50A and the suction and containment position in the compression chamber 50B are provided in the vicinity of the suction portion 38 as in this embodiment, it is preferable to provide such slopes that the heights of the fixed spiral lap 32 and the orbiting spiral lap 42 become higher on the side of the suction portion 38 and are gradually lowered as they separate from the suction portion 38. By providing the fixed spiral lap 32 and the orbiting spiral lap 42 with the slopes in this manner, the gap can be optimized in accordance with a temperature difference at the time of operation.

A slope amount of the fixed spiral lap 32 is greater than that of the orbiting spiral lap 42. Since the temperature of the fixed spiral lap 32 is higher than that of the orbiting spiral lap 42, if the slope amount of the fixed spiral lap 32 is set greater than that of the orbiting spiral lap 42, the gap can be optimized in accordance with the temperature difference at the time of operation.

When the fixed spiral lap 32 and the orbiting spiral lap 42 are provided with the slopes, it is effective to form at least one flat portion on a most outer periphery of the lap in terms of management of lap height.

By making the maximum height of the fixed spiral lap 32 greater than that of the orbiting spiral lap 42, partial contact of the orbiting scroll 40 can be prevented.

In the scroll compressor of the embodiment, thicknesses of the fixed spiral lap 32 and the orbiting spiral lap 42 are reduced toward the spiral-endings of the fixed spiral lap 32 and the orbiting spiral lap 42 and according to this, rigidity of the fixed spiral lap 32 and the orbiting spiral lap 42 is lowered, but since the convex portion 44*a* is formed on the orbiting scroll 40 of the embodiment, it is possible to prevent the partial contact between the edge portion 44 of the orbiting scroll 40 and the inner wall most outer peripheral portion 32*c* of the fixed scroll 30. Therefore, reliability of the fixed spiral lap 32 and the orbiting spiral lap 42 is not deteriorated due to abnormal vibration caused by the partial contact and as a result, it is possible to realize both high performance and high reliability.

In the scroll compressor of the embodiment, the first seal member 141 is placed closer to the discharge space 30H than the second seal member 142 as shown in FIG. 8, and a first seal diameter D1 of the first seal member 141 is set in a range of 10 to 40% of an inner diameter D2 of the hermetic container 10. By making the axial projection area of the high pressure discharge space 30H relatively small in this manner, it is possible to prevent excessive pressing motion by a gas force of the high pressure space in the axial direction toward the orbiting scroll 40 as viewed from the fixed scroll 30. Hence, it is possible to realize high efficient operation in a wide operation range.

FIG. 11 is a sectional view of essential portions showing the first seal member and the second seal member of the hermetic type scroll compressor of the embodiment.

According to the scroll compressor of this embodiment, as shown in an enlarged view of the essential portions in FIG. 11, an annular first projection 153 is provided on a contact surface of each of the closing members 150 with respect to the first seal member 141, and an annular second projection 154 is provided on a contact surface of the closing member 150 with respect to the second seal member 142. The contact surface with respect to the first seal member 141 is an inner peripheral-side upper surface of the ring-shaped member 151 shown in FIG. 9, and the contact surface with respect to the second seal member 142 is an outer peripheral-side upper surface of the ring-shaped member 151 shown in FIG. 9. The enlarged view of the essential portions in FIG. 11 shows two first projections 153 or two second projections 154.

According to this embodiment, the first projection 153 crushes the first seal member 141 into an annular shape and the second projection 154 crushes the second seal member 142 into an annular shape. According to this, it is possible to enhance sealing performance of the first seal member 141 and the second seal member 142.

In the scroll compressor of this embodiment, the partition plate 20 is provided with at least one open hole 155 through which the closed space S and the high pressure space 11 are in communication with each other. The closed space S is closed by the first seal member 141, the second seal member 142, the closing member 150 and the partition plate 20.

According to this embodiment, air trapped in the closed space S at the time of manufacture can be released or opened, and it is possible to prevent the vacuum failure at the time of installation.

INDUSTRIAL APPLICABILITY

The present invention is effective for a compressor of a refrigeration cycle device which can be utilized for electrical products such as a water heater, a hot water heating device and an air conditioner.

[EXPLANATION OF SYMBOLS]

| | |
|---|---|
| 10 | hermetic container |
| 11 | high pressure space |
| 12 | low pressure space |
| 20 | partition plate |
| 21 | second discharge port |
| 30 | fixed scroll |
| 30H | discharge space |
| 30M | medium pressure space |
| 31 | fixed scroll panel |
| 32 | fixed spiral lap |
| 33 | peripheral wall |
| 34 | flange |
| 35 | first discharge port |
| 36 | bypass port |
| 37 | medium pressure port |
| 38 | suction portion |
| 39 | boss portion |
| 40 | orbiting scroll |
| 41 | orbiting scroll panel |
| 42 | orbiting spiral lap |
| 43 | boss |
| 44 | edge portion |
| 44a | convex portion |
| 50 | compression chamber |
| 60 | main bearing |
| 61 | bearing portion |
| 62 | boss-accommodating portion |
| 63 | return-pipe |
| 70 | rotation shaft |
| 71 | eccentric shaft |
| 72 | oil path |
| 73 | suction port |
| 74 | paddle |
| 75 | oil filler |
| 80 | electric element |
| 90 | rotation-restraining member (Oldham-ring) |
| 100 | columnar member |
| 101 | scroll-side concave portion |
| 102 | bearing-side concave portion |
| 111 | medium pressure check valve |
| 121 | bypass check valve |
| 131 | discharge check valve |
| 141 | first seal member |
| 142 | second seal member |
| 150 | closing member |
| 153 | first projection |
| 154 | second projection |
| 155 | open hole |
| S | closed space |

The invention claimed is:

1. A scroll compressor comprising:

a partition plate for partitioning an interior of a hermetic container into a high pressure space and a low pressure space;

a fixed scroll that is adjacent to the partition plate;

an orbiting scroll that is meshed with the fixed scroll and forms compression chambers;

a rotation-restraining member for preventing the orbiting scroll from rotating;

a main bearing for supporting the orbiting scroll, in which the fixed scroll, the orbiting scroll, the rotation-restraining member and the main bearing are placed in the low pressure space, the fixed scroll and the orbiting scroll are placed between the partition plate and the main bearing, and the fixed scroll moves in an axial direction of the fixed scroll between the partition plate and the main bearing;

a boss portion that is formed on a central portion of an upper surface of the fixed scroll and a peripheral wall that is formed around the fixed scroll;

a discharge space that is formed between the partition plate and the fixed scroll and is in communication with the compression chamber;

a ring-shaped first seal member placed on an outer periphery of the discharge space between the partition plate and the fixed scroll; and a ring-shaped second seal member placed on an outer periphery of the first seal member between the partition plate and the fixed scroll, wherein the discharge space is formed in the boss portion by a concave portion, the first seal member and the second seal member are disposed in a ring-shaped concave portion that is formed between the peripheral wall and the boss portion, a pressure in a medium pressure space formed between the first seal member and the second seal member is set lower than a pressure in the discharge space and higher than a pressure in the low pressure space, the first seal member and the second seal member are sandwiched by the partition plate with a closing member, the partition plate is provided with an open hole which brings, into communication with each other, the high pressure space and a closed space, and the closed space is closed by the first seal member, the second seal member, the closing member and the partition plate, the closing member is composed of a ring-shaped member and a plurality of projections formed on one of surfaces of the ring-shaped member, and the projections are inserted into holes formed in the partition plate, the ring-shaped member is pressed against a lower surface of the partition plate, an inner periphery of the first seal member is pressed against an outer peripheral surface of the boss portion, and an outer periphery of the second seal member is pressed against an inner peripheral surface of the peripheral wall, and the closing member is fixed to the partition plate.

2. The scroll compressor according to claim 1, wherein an annular first projection is provided on a contact surface of the closing member with respect to the first seal member, and an annular second projection is provide on a contact surface of the closing member with respect to the second seal member.

3. The scroll compressor according to claim 1, wherein a first seal diameter of the first seal member is in a range of 10 to 40% of an inner diameter of the hermetic container.

4. The scroll compressor according to claim 1, wherein a medium pressure port which brings the compression chamber into communication with the medium pressure space is formed in the fixed scroll, and a medium pressure check valve closing the medium pressure port is provided.

5. The scroll compressor according to claim 1, wherein a thickness between an inner wall and an outer wall of a fixed spiral lap of the fixed scroll and a thickness between an inner wall and an outer wall of an orbiting spiral lap of the orbiting scroll are gradually reduced from spiral-starting ends toward ending-ends of the fixed spiral lap and the orbiting spiral lap.

* * * * *